United States Patent [19]

Felsky

[11] 4,430,205

[45] Feb. 7, 1984

[54] METHOD FOR THE IMPROVEMENT OF THE OXIDATION RESISTANCE OF HYDROCARBON OIL, ESPECIALLY TRANSFORMER OILS BY THE SELECTIVE REMOVAL OF PRO-OXIDANT NITROGEN AND SULFUR COMPOUNDS THEREFROM

[75] Inventor: Gerald Felsky, Sarnia, Canada

[73] Assignee: Exxon Research and Engineering Company, Florham Park, N.J.

[21] Appl. No.: 503,673

[22] Filed: Jun. 13, 1983

[51] Int. Cl.[3] ..... C10G 29/08

[52] U.S. Cl. ..... 208/246; 208/254 R; 208/237; 208/14; 585/843

[58] Field of Search ..... 208/246, 254 R, 237, 208/14; 585/843, 823, 826, 2

[56] References Cited

U.S. PATENT DOCUMENTS

| | | | |
|---|---|---|---|
| 2,768,986 | 10/1956 | Johnson et al. | 585/843 |
| 2,791,540 | 5/1957 | Kimberlin et al. | 208/246 |
| 3,145,161 | 8/1964 | Anderson et al. | 208/246 |
| 3,378,484 | 4/1968 | Ferrara et al. | 208/246 |
| 3,971,712 | 7/1976 | Miller | 208/208 |
| 3,996,130 | 12/1976 | Nametkin | 208/243 |
| 4,113,606 | 9/1978 | Mulaskey | 208/244 |
| 4,163,708 | 8/1979 | Jacobson et al. | 208/89 |
| 4,188,285 | 2/1980 | Michlmayr | 208/246 |
| 4,204,947 | 5/1980 | Jacobson et al. | 208/243 |

FOREIGN PATENT DOCUMENTS

| | | |
|---|---|---|
| 2624239 | 12/1977 | Fed. Rep. of Germany . |
| 49-75686 | 3/1974 | Japan . |
| 51-75515 | 12/1976 | Japan . |
| 542396 | 2/1978 | U.S.S.R. . |
| 857230 | 8/1981 | U.S.S.R. . |

OTHER PUBLICATIONS

"Determination of Sulfur Compounds in High Boiling Petroleum Distillates by Ligand-Exchange Thin Layer Chromatography", Kaimai, et al., Anal. Chem. 50 (2), Feb. 1978, pp. 268-270.

"Isolation of Thiophenic Compounds in Shale Oil by Argentation Liquid Chromatography", Joyce and Uden, 1983 Pittsburgh Conference and Exposition on Analytical Chemistry and Applied Spectroscopy, Anal. Chem. 55, (1983) pp. 540-543.

"Separation of Organic Sulfides from Aromatic Concentrates by Ligand Exchange Chromatograhy", Vogh & Dooley, Anal. Chem. 47 (6), May, 1975, pp. 816-821.

"Status of Work in Separation and Identification of Sulfur Compounds in Petroleum and Shale Oil", Dean, et al., 7th World Pet. Cong. Prac. 9, 1967 pp. 165-175.

"The Liquid-Liquid Extraction of Organic Sulfide with a Transition Metal Ion", Yotsuyanaji, et al., Bunseki Kogaku 18, No. 12, p. 1487 (1969).

"Aqueous Zinc Chloride as a Stationary Phase for Liquid-Liquid Chromatography of Organic Sulfides", Orr, Anal. Chem. 39 (10), Aug. 1967, p. 1163.

"Nitrogen and Oxygen Compounds Types in Petroleum", Snyder, Anal. Chem. 41 (2) 1969, p. 314.

"Soprtion of Sulfides by Salt Forms of Ion Exchange and by Zeolites from Organic Solvents", Labanova, et al., Zh prikl Khim (Leningrad) (1977), 50 (6) 1327-1331 (Abstract).

"Removal of Mercaptans from Petroleum Products", Katova, et al., Tezisg Dokl Nauchn Sess Khim Teknol Org Svedin Serv Sernestykl Neftet 13th 1974, 46 (7) (Abstract).

*Primary Examiner*—Delbert E. Gantz

*Assistant Examiner*—Anthony McFarlane

*Attorney, Agent, or Firm*—Joseph J. Allocca

[57] ABSTRACT

Liquid hydrocarbon streams, preferably petroleum streams, most preferably lube and specialty oil streams and in particular transformer oils are rendered resistant to oxidation by treatment with a silver salt impregnated adsorbent, preferably silver nitrate impregnated alumina by the process of contacting the hydrocarbon oil stream with the silver salt impregnated adsorbent and recovering a hydrocarbon stream of reduced pro-oxidant heteroatom compound (nitrogen compound and sulfur compound) content. The silver salt impregnated adsorbent is regenerated by sequential washing with portions of aromatic solvent and polar solvent. The aromatic solvent strips aromatic sulfides from the adsorbent. This fraction may be recombined with the hydrocarbon stream, especially in the case of transformer oils, so as to enhance the oxidation stability/resistance of the oil. The polar solvent, such as 3% methanol in toluene, strips the aliphatic sulfides from the absorbent. The regenerated column is then ready for reuse.

15 Claims, 1 Drawing Figure

METHOD FOR THE IMPROVEMENT OF THE OXIDATION RESISTANCE OF HYDROCARBON OIL, ESPECIALLY TRANSFORMER OILS BY THE SELECTIVE REMOVAL OF PRO-OXIDANT NITROGEN AND SULFUR COMPOUNDS THEREFROM

BRIEF DESCRIPTION OF THE INVENTION

Liquid hydrocarbon streams, preferably petroleum streams, most preferably lube and specialty oil streams and in particular transformer oils are rendered resistant to oxidation by treatment with a silver salt impregnated adsorbent, preferably silver nitrate impregnated alumina by the process of contacting the hydrocarbon oil stream with the silver salt impregnated adsorbent and recovering a hydrocarbon stream of reduced pro-oxidant heteroatom compound (nitrogen compound and sulfur compound) content. The silver salt impregnated adsorbent is regenerated by washing with portions of aromatic solvent and polar solvent. The aromatic solvent strips aromatic sulfur from the adsorbent. This fraction may be recombined with the hydrocarbon stream, especially in the case of transformer oils, so as the enhance the oxidation stability/resistance of the oil. The polar solvent, such as 3% methanol in toluene, strips the aliphatic sulfides from the adsorbent. The regenerated column is then ready for reuse after drying or after flushing with aliphatic solvent.

THE INVENTION

Figure 1:
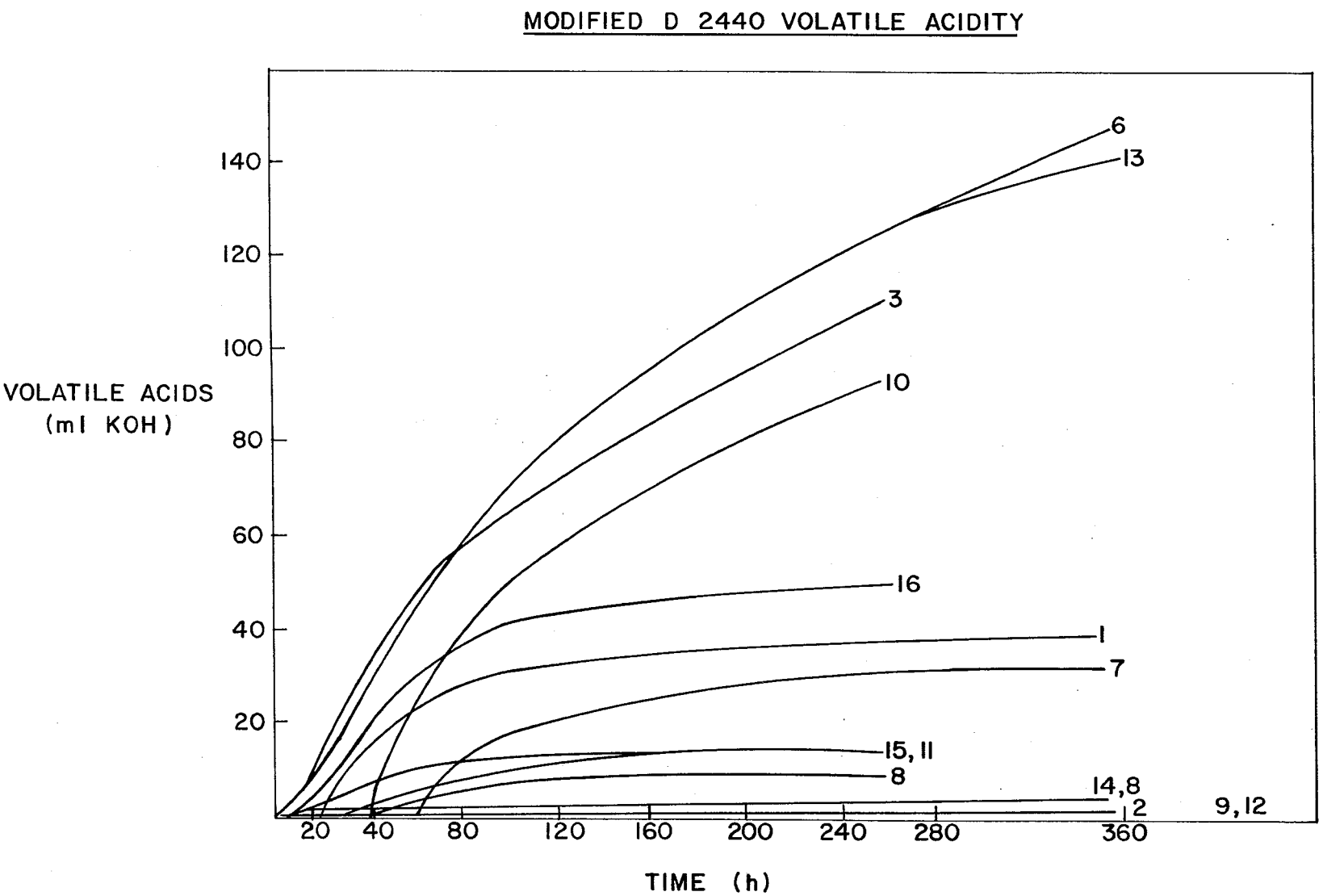
FIG. 1 presents the relationship between the volatile acid production of 16 oils over time as determined by a modified ASTM D2440 test procedure.

The oxidation performance of oils is improved by the removal of the nitrogen compounds, in particular the basic nitrogen compounds, and of the sulfur compounds, in particular the aliphatic sulfur compounds. These materials are those selectively removed from the hydrocarbon stream by use of silver salt impregnated adsorbent. Basic nitrogen compounds and aliphatic sulfides are the components of the hydrocarbon oil stream which function as the prooxidants. Oxidation test at 110° C. show aliphatic sulfur compounds to be detrimental to the oxidation stability of oils. Their removal proves to be especially beneficial in the production of transformer oils which tend to be utilized under the milder conditions simulated by the 110° C. oxidation tests. However, oxidation tests at 165° C. show that even the aliphatic sulfur compounds behave as anti-oxidants. Conversely, aromatic sulfur compounds function as anti-oxidants under both sets of test conditions and their presence in the hydrocarbon stream proves to be most beneficial in all cases. It has been determined that, by the practice of the present invention aliphatic sulfides, and basic nitrogen compounds are preferentially removed from the stream, with only minor quantities of aromatic sulfur compounds being removed by the silver salt impregnated adsorbent when followed by an aromatic solvent wash. The hydrocarbon oil feed stream can be passed through the silver salt impregnated adsorbent bed along with an aromatic solvent wash (eg toluene). The oil and the aromatic sulfur are passed through the column with the aliphatic sulfur compounds being retained. These aliphatic sulfur compounds can be stripped from the column using a polar solvent.

Alternatively the hydrocarbon oil feed stream can be passed through silver salt impregnated adsorbed column with an aliphatic solvent diluent. The oil passes through the column while all the sulfur compounds (aromatic and aliphatic) are retained. The column can then be washed with aromatic solvent to selectively recover the aromatic sulfur followed by a polar solvent wash to recover the aliphatic sulfur compound fraction. Alternatively, the column can be washed using only polar solvent in which case both aromatic sulfur and aliphatic sulfur compounds are removed from the column together.

Preferably, these various sulfur compounds will be recovered and the silver salt impregnated adsorbent regenerated by sequential washing with the series of solvents. Use of the aromatic solvents such as toluene selectively strip the aromatic sulfur compounds from the silver salt impregnated adsorbent. If the aromatic solvent, e.g., toluene wash is followed by a more polar solvent wash, e.g., alcohol/aromatic solvent such as methanol/toluene wash, the aliphatic sulfur compounds are stripped from the silver salt impregnated adsorbent. In this manner different cuts of sulfur compounds can be isolated and an anti-oxidant extract comprising aromatic sulfur compounds can be isolated. This recovered antioxidant extract of aromatic sulfur compounds can be used as an additive to enhance the oxidation resistance of an oil, i.e. either the same oil from which they have been separated or a different oil in order to impart oxidation resistance to that oil. Preferably, the aromatic sulfur is retained by the treated oil by either following the oil extracting treatment with an aromatic solvent wash of the silver salt/adsorbent and combining the fractions (oil and aromatic solvent wash) or by using the aromatic solvent as the oil diluent to start in which instance the oil and the aromatic sulfur pass through the silver salt impregnated adsorbent simultaneously.

In another embodiment the hydrocarbon stream containing the nitrogeneous and sulfurous components is mixed with a portion of silver salt impregnated adsorbent and then percolated over a bed of fresh adsorbent. This procedure can take a number of different forms, for example, the hydrocarbon stream can be mixed and agitated with the silver salt impregnated adsorbent, left to settle, then filtered through a bed of silver salt-adsorbent. Alternatively, the silver salt impregnated adsorbent can constitute a layer present over a separate salt free layer of adsorbent. Other variations readily apparent to the practitioner can also be employed and are deemed to be within the scope of the present invention. The silver salt free layer of adsorbent functions to reduce the amount of silver salt which is entrained and/or complexed with the oil after treatment. Since the extent of sulfur compound removal can be controlled by control of the concentration of silver salt, more extensive sulfur compound removal being effected by use of a high concentration of metal salt, this procedure of passing the silver salt treated hydrocarbon oil through a bed of salt free adsorbent is very beneficial in reducing the overall loss of silver salt in the process.

Basically, any hydrocarbon stream which contains basic nitrogen compounds and sulfur compounds can be treated by the process of the present invention. In general, the hydrocarbon streams are derived from any natural or synthetic source. Oils produced from Saudi Arabia, Barosa, East Texas, Louisiana, Kuwait, Libya, the North Sea, etc., can be effectively denitrogenated and desulfurized by the process of the present invention and it is probable that even synthetic oil derived from coal, tar sands or shale should be benefitted by the present process. Preferably, the oils which are treated are the natural petroleum oils and most preferably the oils are distillate, raffinate or bright stock basestocks falling in the lube oil and specialties oil categories (i.e., transformer oil, white oil, refrigerator oils, aviation turbine oils, etc.) although the hydrocarbon steam can be in the liquid or vapor form, it is preferred that the hydrocarbon oil stream being treated be in the liquid form since if the stream is in the vapor form it may be at so high a temperature that the surface compounds are degraded, rendering the aromatic sulfur compounds unrecoverable.

The process of the present invention is especially applicable to the production of transformer oils or insulating oils. As the supply of high quality crude for the production of transformer oil decreases these premium crudes are being replaced by lower quality oils and new or more severe refining techniques are needed to maintain product quality.

The procedure of the present invention provides a method for the selective removal of aliphatic sulfides from conventionally refined transformer oil. The removal of these sulfides is shown to improve tthe oxidation response of the oil in standard industry tests. Yields are almost 99%. This improvement in oil performance resulting from the practice of the present invention should reduce if not eliminate the need for increasing the additive treat of these oils. Adding additive and/or changing the composition of additive packages are steps taken only reluctantly by the electrical industry.

In practicing the invention the hydrocarbon stream is contacted with the silver salt impregnated adsorbent in any desirable manner. In the absence of a diluting solvent, increased temperature, pressure and/or time is required to effect the desired selective removal, especially for the heavier oils. Preferably, a diluent such as an aliphatic or aromatic hydrocarbon is employed to facilitate handling. While the quantity of type and amount of dilution will, of course, depend on the oil being processed, dilution will typically involve from about 0 to 10 more typically about 0.5 to 5 volumes of diluent per volume of oil, the preferred aliphatic diluent being a $C_x$–$C_y$ aliphatic the preferred aromatic diluent being benzene, xylene or, most preferably, toluene. This contacting can take the form of contacting under agitation with a given quantity of silver salt impregnated adsorbent, followed by percolation through silver salt free bed of adsorbent to separate out and recover entrained/complexed silver salt. Alternatively, the hydrocarbon stream can be passed through a multi-layer bed constituting a layer of silver salt impregnated adsorbent on top of a layer of salt free adsorbent. Even combinations of the procedures are within the scope of operation, to wit: the hydrocarbon stream is slurry agitated with a quantity of silver salt impregnated adsorbent. The slurry is then percolated through a multi-layer bed constituting a layer of silver salt impregnated adsorbent on top of a layer of salt free adsorbent. While these multiple layer procedures are the preferred method for conducting the nitrogen compound/sulfur compound separation, procedures involving simply contacting the hydrocarbon stream with the silver salt impregnated adsorbent either by simple admixing with the adsorbent or percolation through a single layer bed of salt impregnated adsorbent, are also contemplated and totally operable and acceptable.

The contact of hydrocarbon oil with silver salt impregnated adsorbent may be conducted under quiescent (i.e., percolation) or agitated conditions (see above) and at any temperature and pressure which is convenient.

Temperatures are selected such that the hydrocarbon stream is liquid, preferably about 20° C., but higher temperatures can also be used but too high temperatures are to be avoided so as not to degrade the aromatic sulfur compounds. Pressure of passage, if percolation is employed, can range from gravity flow and higher. The hydrocarbon stream is contacted with the silver salt impregnated adsorbent for from about 60 to 300 minutes, i.e., either rapid once through percolation or prolonged contacting depending, of course, on feed stream viscosity, temperature and solvent used.

The ratio of silver salt impregnated adsorbent to oil is more critical. The amount of sulfur compound removed can be controlled by adjusting the ratio of silver salt impregnated adsorbent to oil, more extensive sulfur compound removal being effected by use of higher ratios of silver salt impregnated adsorbent to oil ratios of from about 2/1 to about 20/1 are effective, preferably 4/1 to 10/1.

In addition to the ratio, the loading concentration of the silver salt on the adsorbent is also important, this also controlling to some extent the effectiveness of sulfur compound removal. Silver salt loading levels of from about 2 wt.% to 10 wt.% can be employed, preferably about 3–6 wt.%, most preferably about 4 wt.%. for total aliphatic sulfide removal and 10 wt.% for total (both aromatic and aliphatic sulfur compound) removal.

The silver salts which are used may be selected from the group of silver salts which are aromatic, aliphatic, alcohol insoluble and stable. The silver salt can be loaded onto the support from a solution, eg an aqueous solution. Alternatively, if the silver salt is in a finely divided form it can be mechanically admixed with the support to give an intimate mixture. Silver fluoride, silver nitrate, silver sulfate are examples of silver salts which should work in the present process. Silver nitrate is most preferred.

This silver salt is impregnated into an adsorbent which adsorbent is selected from the group consisting of any inert solid support such as clay, silica gel, any inert refractory oxide such as alumina or Florisil, but alumina is most preferred.

The silver salt may be dissolved in a solvent, such as water and mixed with the inert solid support adsorbent, such as alumina. The mixture is dried, for example, for about 8–18 hours at about 120° C. if water is the solvent, the drying temperature of course being dependent on what solvent is used to deposit the silver salt in the adsorbent.

After contacting the hydrocarbon stream with the silver salt impregnated adsorbent, the adsorbent now containing the basic nitrogen compounds and sulfur compounds can be regenerated for re-use by washing with a solvent and drying.

As previously indicated aromatic sulfur compounds can be selectively recovered from the adsorbent by washing using an aromatic solvent such as toluene. Aliphatic sulfide compounds are recovered by following the aromatic solvent wash above, with a wash employing more polar solvents such as alcohol/aromatic mixture, e.g., methanol/toluene, preferably 3% MeOH in toluene. The polar wash solvent solution can be any alcohol in any aliphatic or aromatic solvent in which they are soluble. Wash solvents can also be acetone, ethylacetate, methylacetate, acetonitrile, dioxane, nitromethane or mixtures containing alcohols (preferably up to 5% alcohol).

EXAMPLE 1

110 grams of a 150 N basestock oil containing 0.41% sulfur was treated using a 4% silver nitrate/alumina adsorbent.

The silver nitrate loaded alumina was prepared by adding 8 grams silver nitrate (99.999% pure) to 120 ml of distilled water. This solution was then added to 200 grams alumina (acidic alumina 90 active 70–230 mesh) in a foil wrapped flask. Additional water was added as necessary to insure that the alumina becomes thoroughly wet, and the mixture was mixed thoroughly. The water was then removed from the material on a roto evaporator (water bath at 80° C.). The material was then dried in an oven at 120° C. for 18 hrs then cooled in a dessicator (drierite).

The separator column was 100 cm in length and had an internal diameter of 25 mm. The column bottom is stopped with glass wool or a fritted glass disk. 100 grams of clean Amberlyst was added followed by 20 grams of acidic alumina. The silver nitrate loaded alumina was slurried with toluene and this slurry was added to the column which had been wrapped with foil in the area occupied by the silver nitrate loaded alumina. 3 grams of silica sand (fine granular) was added to top off the column. The column was kept in a flow of toluene.

The oil sample was prepared by adding to it an equal volume of toluene.

When the oil sample was ready the toluene flow through the column was stopped and the toluene was permitted to recede into the sand. The oil/toluene mixture was then added to the column. The flask holding the mixture was washed with an added volume of toluene. As the last of the oil/toluene mixture receded into the silica sand in the column the toluene washing from the flask was added to the column. As the last of the washing receded into the sand a volume of toluene (1375 ml) was added to the column as the first eluting solvent. As the last of this toluene solution receded into the sand a volume of 3% methanol in toluene (1375 ml of mixture) was added to the column as a second eluting solvent.

Separate cuts were collected (on the basis of volumes corresponding to the volumes added to the top of the column) as they passed through the column yielding an oil-toluene elution fraction and a methanol-toluene elution fraction.

The toluene and methanol-toluene fractions were stripped on a rotary evaporator at 40° C. and 1 mm Hg vacuum.

The alkylsulfides were contained in the methanol-toluene fraction. These alkylsulfides (after solvent stripping) were dissolved in ether, shaken with $NaHCO_3$ solution so as to remove any acids which may have formed. The alkylsulfide content of the various streams was determined using the method of Drushel and Miller in Anal. Chem. 29 (10) 1456 (1957).

The results of this Example are presented in Table I.

TABLE I

150N Basestock Treated on 4% $AgNo_3$/Alumina

| | Base | Toluene Fraction | 3% MeOH/Toluene Fraction |
|---|---|---|---|
| wt. of Sample (gm) | 110 | 108 | 1.8 |
| % Sulfur (total) | 0.41 | 0.31 | 7.43(1) |
| % Sulfur (aliphatic) | 0.08 | 0.01 | 5.24(1) |
| Basic Nitrogen (ppm) | 43 | <1 | <1 |

(1)Based on 1.8 gm of sample in the methanol-toluene fraction.

There is seen to be a 9 to 1 concentration of aliphatic sulfur by weight in the methanol-toluene fraction vs. the toluene fraction.

EXAMPLE 2A

Following the same general procedure of Example 1, a phenol extracted transformer oil was desulfided. 4% $AgNO_3/Al_2O_3$ was again employed. The phenol extracted transformer oil base stock contained 0.12% sulfur total. Separation yielded a desulfided oil fraction and an alkylsulfide fraction. A separate comparative fraction of totally sulfur free oil was prepared by Hydrofining a sample of base oil. Hydrofining conditions employed in this example are a temperature of about 325° C.; a hydrogen pressure of 400 psi; a feed rate of 0.5 v/v/hr; $H_2$ gas rate of 6000 SCVF/BBL; a stripper temperature of 100° C. and 4.5–5.5 wt% NiO/19–22% $MoO_3$ on alumina commercial catalyst from American Cyanamid.

These fractions were examined (in various combinations) for oxidation stability using the Cecil test (R. Cecil, Journal of Institute of Petroleum 59, 201, 1973) and a modification of the Cecil test. These test conditions are detailed below:

TABLE II

| | Modified Cecil | Cecil |
|---|---|---|
| Sample weight (g) | 25 | 25 |
| Catalyst | Cu Wire | Cu + Fe Wires |
| Oxidant | $O_2$ | $O_2$ |
| Flow Rate (ml $min^{-1}$) | 100 | 100 |
| Temperature (°C.) | 165 | 165 |
| Duration (h) | 54 | 54 |
| Observe: | Volatile Acidity Soluble Acidity % Viscosity Increase | % Viscosity Increase |

The various samples were tested in various combinations to determine the effect of the presence or absence of aromatic sulfur and aliphatic sulfur compounds. All samples contained 0.3% ditertiary butyl para cresol (DBPC).

2-ml Aliquots were taken during each test, filtered and kinematic viscosities (40° C.) obtained. Volatile acidity (VA) was monitored, and soluble acidity (SA) determined at the end of the test. Results are tabulated below:

TABLE III

MODIFIED CECIL TEST RESULTS ON PHENOL EXTRACTED TRANSFORMER OIL

| Sample(1) test | % Vis Increase | VA | SA |
|---|---|---|---|
| B + D (no Cu)(3) | 23 | 6.5 | 2.5 |
| C (no Cu) | 73 | 19.9 | 7.6 |
| B (Cu present) | TVTM(2) | 40.4 | 31.3 |
| A (no Cu) | 19 | 2.2 | 1.4 |

TABLE III-continued

MODIFIED CECIL TEST RESULTS ON PHENOL EXTRACTED TRANSFORMER OIL

| Sample[1] test | % Vis Increase | VA | SA |
|---|---|---|---|
| B + D (Cu present) | 38 | 12.9 | 5.1 |
| C (Cu present) | 155 | 36.0 | 16.5 |
| A (Cu present) | 35 | 9.9 | 4.0 |
| B (no Cu) | TVTM | 75.0 | 37.5 |

[1]A = basestock
B = hydrofined basestock
C = $AgNO_3/Al_2O_3$ treated oil (aromatic sulfur present 0.05%)
D = Alkyl sulfides fraction (5.8% sulfur; 3.95% aliphatic sulfides)
[2]TVTM = Too viscous to measure, removed from test at 30 hours.
[3]Enough D is added to B to give a total sample (B + D) sulfur content of 0.05% sulfur.

Variable effects over the course of total test run period are summarized below:

TABLE IV

SUMMARY OF VARIABLE EFFECTS - MODIFIED CECIL TEST

| Significance | 95% | | 90% | | 90% | |
|---|---|---|---|---|---|---|
| Effect | Antioxidant | Pro-Oxidant | Antioxidant | Pro-Oxidant | Antioxidant | Pro-Oxidant |
| Variables | | | | | | |
| Volatile Acids | — | — | — | — | — | — |
| SA | — | — | — | — | RS | — |
| | — | — | — | — | BT | — |
| % Viscosity Increase | RS[1] | — | BT[2] | RS/BT | — | — |

[1]RS = alkyl sulfides present in oil
[2]BT = aromatic sulfides present in oil

Since the calculation of variance is restricted in this case by there being only one degree of freedom significance values must be interpreted with care. For example, the unlikely aliphatic sulphide/aromatic sulphur pro-oxidant interaction at 90% significance can be shown to be an artifact of the arbitrary selection of final viscosity values for the two samples which were too viscous to measure. Nevertheless it is clear that both sulphur types are acting as antioxidants, (and the role of copper is less as compared to the results reported in the following Example 2B, Table VII).

(b) An NMP extracted transformer oil was similarly examined. This oil was first chromatographed on a column of silica (for the details of the procedure see Example 4 below), yielding a saturates fraction, an aromatics fraction and a polar fraction. The aromatics fraction containing all the sulfur compounds was then treated in a column of $AgNO_3$/alumina yielding an aromatic sulfur fraction and an aliphatic sulfur fraction.

These fraction were examined (in various combinations) for oxidation stability using a modified ASTM D2440 test procedure; (see below).

TABLE V

| | Modified D 2440 |
|---|---|
| Sample weight (g) | 25 |
| Catalyst | Cu Wire |
| Oxidant | $O_2$ |
| Flow Rate (ml $min^{-1}$) | 17 |
| Temperature (°C.) | 110 |
| Duration (h) | 360— |
| Observe: | Volatile Acidity<br>Soluble Acidity<br>% Sludge<br>Induction Time |

The various samples reacted above and a Hydrofined sample (Hydrofining conditions: temp. of 340° C., pressure 2.45 MpA, LHSV, 1.3 V/V/h, commerical catalyst of $NiO/MoO_3$ (about 6.7% NiO/27% $MoO_3$) on alumina from Nalco) to which was added a quantity of cut G, the aliphatic sulfide fraction, to give that sample a sulfur content of 0.03% were tested in a number of combinations to determine the effects of the presence or absence of aromatic sulfur, aliphatic sulfur, inhibitor and copper catalyst on oxidation stability. The results are reported below.

TABLE VI

MODIFIED ASTM-D 2440 TEST RESULTS ON NMP EXTRACTED TRANSFORMER OIL

| Sample Test[1] | VA | SA | % Sludge | TOP | Induction Time (hrs) |
|---|---|---|---|---|---|
| B + G[2]/− Cu, − inhibitor | 9.1 | 7.5 | 2.6 | 7.9 | 10 |
| C + F + E/− Cu, − inhibitor | 0.4 | 0.2 | 0.1 | 0.3 | >360 |
| B/+ Cu, − inhibitor | 30.8 | 16.2 | 16.9 | 31.9 | 10 |
| B/− Cu, + inhibitor | 0.1 | 0.3 | 0 | 0.1 | >360 |
| A/− Cu, − inhibitor | 2.4 | 1.6 | 0.4 | 1.7 | 36 |
| B + G/+ Cu, − inhibitor | 34.8 | 16.1 | 23.3 | 39.6 | 6 |
| B + G/− Cu, + inhibitor | 7.5 | 5.9 | 2.0 | 6.3 | 58 |
| C + F + E/+ Cu, − inhibitor | 0.9 | 0.3 | 4.2 | 4.6 | >360 |
| C + F + E/− Cu, + inhibitor | 0.1 | 0.1 | 0 | 0.1 | >360 |
| B/+ Cu, + inhibitor | 25.5 | 14.9 | 32.6 | 45.6 | 37 |
| A/+ Cu, − inhibitor | 3.7 | 2.6 | 0.9 | 2.9 | 24 |
| A/− Cu, + inhibitor | 0 | 0.1 | 0 | 0 | >360 |
| B + G/+ Cu, + inhibitor | 33.5 | 18.0 | 17.3 | 33.8 | 6 |
| C + F + E/+ Cu, + inhibitor | 1.0 | 0.6 | 0.3 | 0.9 | >360 |
| A/+ Cu, + inhibitor | 3.8 | 3.1 | 0.9 | 3.1 | 18 |
| B/− Cu, − inhibitor | 12.1 | 8.9 | 3.5 | 10.2 | 17 |

[1]A = basestock oil
B = hydrofined oil basestock
C = Saturates fraction (following silica gel chromatorgraphy)
E = Polars fraction (following silica gel chromatography)
F = Aromatic fraction (following 4% $AgNO_3$/Alumina treatment)(aromatic sulfur 0.07% S)
G = Aliphatic fractions (following 4% $AgNO_3$/Alumina treatment)
Inhibitor, 0.06% DBPC; − means no inhibitor, + means inhibitor present.
[2]Enough aliphatic fraction G added to B to give a sulfur content of 0.03% S.

Volatile acidity was monitored, and the tests terminated at 360 hours. At that time the total oxidation product (TOP) was determined: TOP—(volatile acids+soluble acids)×0.3209+wt% sludge. Volatile Acidity was plotted against time (FIG. 1) and from this the induction period was determined.

Variable effects over the course of total test run period are summarized below:

TABLE VII

SUMMARY OF VARIABLE EFFECTS - MODIFIED D 2440 NMP EXTRACTED OIL

| Significance Effect | 99% Anti-oxidant | 99% Pro-Oxidant | 95% Anti-oxidant | 95% Pro-Oxidant | 90% Anti-oxidant | 90% Pro-Oxidant | 80% Anti-oxidant | 80% Pro-Oxidant |
|---|---|---|---|---|---|---|---|---|
| Variable | | | | | | | | |
| Volatile Acids | BT | Cu | — | RS | IN | — | — | BT/In |
| | BT/Cu | — | — | — | — | — | — | — |
| Soluble Acids | BT | Cu | — | — | — | — | In | RS |
| | BT/Cu | — | — | — | — | — | — | Cu/In |
| % Sludge | BT | Cu | BT/Cu | — | — | — | — | — |
| TOP | BT | Cu | — | — | — | — | — | — |
| | BT/Cu | — | — | — | — | — | — | — |
| Induction Time | — | — | BT | — | — | — | In | Cu |

RS = alkyl
BT = aromatic sulfur
Cu = copper catalyst
In = DBPC inhibitor

The low significance of catalysis and inhibition on the induction period is a result of six of the sixteen oils on test not having begun to breakdown by 360 hours. The calculations would probably reveal a highly significant dependence if actual induction periods could have been measured.

Aromatic sulfur compound and/or an aromatic sulfur-copper catalyst interaction are the only significant variables contributing to antioxidancy in this test. Aliphatic sulphides significantly reduce the induction period. There is no significant interactions involving the inhibitor.

The modified ASTM D2440 test is a good approximation of the conditions experienced by a transformer oil under typical operating conditions. From the results of this test it is seen that the presence of aliphatic sulfides is detrimental while the retention of aromatic sulfur by the oil is beneficial. The silver nitrate/alumina separation procedure of the present invention is a technique for ensuring the presence of aromatic sulfur and the absence of aliphatic sulfur in transformer oil and will be especially useful for the products of transformer oil from low quality base stocks.

EXAMPLE 3

A sample of 150 N oil (2 g) was put into an aluminum foil wrapped flask and 60 ml of 5% toluene in heptane was added to it. 10 grams of 10% $AgNO_3$/alumina was added to the flask and stirred at room temperature in the dark for 4 hours.

A 30 cm×1.15 cm (ID) separation column was prepared as follows. 2 gms of $AgNO_3$ was dissolved in 12 ml distilled water and added to 18 grams of alumina. Additional water added as needed to insure that the alumina was thoroughly wetted. The mixture was mixed well, then the water was stripped off on a roto separation and the sample dried as per Example 1. The column was prepared by plugging the end with a 1 cm plug of glass wool. The column was wrapped with aluminum foil. 10 grams of the 10% $AgNO_3/Al_2O_3$ mix was slurried with 5% toluene in heptane and added to the column. 2 gms of fine granular silica sand was added as an end plug on top of the $AgNO_3$/alumina.

The oil/toluene-heptane-10% $AgNO_3$/alumina mixture, after the 4 hours of slurrying, was then added to the prepared column. The alumina was permitted to settle and another 2 grams of silica sand was added. When the oil and solvent mixture receded into the sand (the second plug recited above), 40 ml of 5% toluene in heptane was used to rinse the sample flask and the walls of the column After the rinse receded into the sand a further 40 ml portion of 5% toluene in heptane was added to the column. Total sulfur removal was 85%.

EXAMPLE 4

NMP extracted transformer oil with a sulfur content of 0.1% was used as the base stock oil. This oil was first chromatographically separated using silica gel, 70 grams of the oil was dissolved in 400 ml heptane. This solution was added to a column containing 5 liters of Grade 12 silica gel (Davison) and permitted to pass through the column. Saturates (paraffins and naphthenes) were washed from the column and collected using 7 liters of heptane while aromatics (aromatics and sulfur compounds) were washed from the column and collected using 7 liters of toluene. Polar compounds (oxygen and nitrogen compounds) were washed from the column using 7 liters of acetone. The solvents were evaporated from the fractions and the residues were recovered.

5.0 grams of the aromatics fraction (without dilution) were added to 50 grams of different adsorbents in a 1.5 cm (internal diameter) by 30 cm (length) column. Two fractions were recovered. One fraction was recovered using a toluene wash (aromatic sulfur) while the second fraction (aliphatic sulfides) was recovered using a 3% methanol/toluene wash. The results are presented in Table VIII below which reports the efficacy of 11 different adsorbent materials.

TABLE VIII

DESULFIDING OF EXOL N TRANSFORMER OIL AROMATICS

| Fraction | % Recovery Toluene 1 | % Recovery MeOH/Toluene 2 | % of Total S Toluene 1 | % of Total S MeOH/Toluene 1 | Aliphatic Sulfide* Toluene 1 | Aliphatic Sulfide* MeOH/Toluene 2 |
|---|---|---|---|---|---|---|
| Column | | | | | | |
| A Silica Gel | 100 | 0 | 100 | 0 | 33 | 0 |
| B A + 4% $AgNO_3$ | 88 | 3 | 41 | 50 | 0 | 40 |
| C Florisil | 97 | 1 | 82 | 6 | 27 | 5 |

TABLE VIII-continued

DESULFIDING OF EXOL N TRANSFORMER OIL AROMATICS

| Fraction | % Recovery | | % of Total S | | Aliphatic Sulfide* | |
|---|---|---|---|---|---|---|
| | Toluene 1 | MeOH/ Toluene 2 | Toluene 1 | MeOH/ Toluene 1 | Toluene 1 | MeOH/ Toluene 2 |
| D C + 4% $AgNO_3$ | 96 | 4 | 29 | 49 | 0 | 32 |
| E Alumina | 95 | — | 29 | — | 26 | — |
| F E + $CrBr_3$ | 99 | — | 104 | — | 28 | — |
| G E + $TiCl_4$ | 89 | — | 82 | — | 18 | — |
| H E + Pd | 98 | — | 78 | — | 26 | — |
| I E + 4% $AgNO_3(CH_3CN)$ | 93 | 5 | 55 | 16 | 10 | 52 |
| J E + 4% $AgNO_3(H_2O)$ | 95 | 3 | 72 | 35 | 1 | 76 |
| K E + 8% $AgNO_3$ | 98 | 3 | 26 | 38 | 0 | 65 |

*As % of total % S.

Since the aromatic starting material was obtained by silica get separation, Column A (silica gel) should, by definition, give no retention and this is what occurs. Column B shows retention of approximately 50% of the sulfur but only 40% of the sulfur in this fraction in aliphatic sulfide. Column J provides the most effective conditions for the desired separation. In column J, 4% $AgNO_3$ impregnation of alumina concentrates all the aliphatic sulfides into 3 wt% of the sample. 76% of the sulfur in this fraction (5–7% sulfur) is aliphatic sulfide.

This example demonstrates that silver nitrate impregnated alumina is the most desirable salt/adsorbent combination.

What is claimed is:

1. A method for improving the oxidation resistance of hydrocarbon oils comprising contacting a hydrocarbon oil stream containing nitrogen and sulfur containing compounds with a silver salt impregnated adsorbent whereby the nitrogen and sulfur containing compounds are taken up by the silver salt impregnated adsorbent, and thereby removed from the hydrocarbon oil, contacting an aromatic solvent with the silver salt impregnated adsorbent to remove the aromatic sulfur compounds from said silver salt impregnated adsorbent and combining said aromatic sulfur compounds with either the extracted hydrocarbon oil stream or a different hydrocarbon oil stream thereby improving the oxidation resistance of said hydrocarbon oil.

2. The method of claim 1 wherein the aromatic solvent is mixed with the hydrocarbon oil stream to be extracted as a diluent resulting in the aromatic sulfur compounds not being adsorbed by the silver salt impregnated adsorbent and being retained by the hydrocarbon oil stream.

3. The method of claim 1 or 2 wherein the silver salt impregnated adsorbent comprises silver nitrate impregnated alumina.

4. The method of claim 1 or 2 wherein the adsorbent is impregnated with from 2 to 10 wt % silver salt.

5. The method of claim 3 wherein the alumina is impregnated with from 2 to 10 wt % silver nitrate.

6. The method of claim 1 or 2 wherein the hydrocarbon oil is contacted with the silver salt impregnated adsorbent for from 60 to 300 minutes.

7. The method of claim 1 or 2 wherein the hydrocarbon oil is contacted with the silver salt impregnated adsorbent at a silver salt impregnated adsorbent to hydrocarbon oil ratio of from about 2/1 to about 20/1.

8. The method of claim 1 or 2 wherein the hydrocarbon oil is contacted with the silver salt impregnated adsorbent by passing the hydrocarbon oil through a bed of silver salt impregnated adsorbent.

9. The method of claim 3 wherein the hydrocarbon oil is contacted with the silver nitrate impregnated alumina by passing the hydrocarbon oil through a bed of silver nitrate impregnated alumina and wherein the aromatic solvent is contacted with the silver nitrate impregnated alumina containing the extracted nitrogen and sulfur compounds by passing the aromatic solvent through the silver nitrate impregnated alumina.

10. The method of claim 1 or 2 wherein following the contacting of the silver salt impregnated adsorbent with aromatic solvent and the removal of the aromatic sulfur compounds thereby from the adsorbent, the silver salt impregnated adsorbent is washed with a polar wash solvent to removed adsorbed aliphatic sulfides from the silver salt impregnated adsorbent, thereby regenerating the adsorbent for reuse in the hydrocarbon oil extraction process.

11. The method of claim 1 or 2 wherein the aromatic solvent is benzene, toluene or xylene.

12. The method of claim 11 wherein the aromatic solvent is toluene.

13. The method of claim 10 wherein the polar solvent is a mixture of alcohol in aromatic or aliphatic solvent.

14. The method of claim 13 wherein the polar solvent is up to 5% alcohol in aromatic or aliphatic solvent.

15. The method of claim 10 wherein the hydrocarbon oil stream is a transformer oil basestock and the recovered aromatic sulfur compounds are added thereto.

* * * * *